US006247284B1

(12) United States Patent
Alvarez et al.

(10) Patent No.: US 6,247,284 B1
(45) Date of Patent: Jun. 19, 2001

(54) ROOF TILE DESIGN AND CONSTRUCTION

(75) Inventors: Alfonso V. Alvarez, San Bernidino, CA (US); Woods W. Burnett, North Augusta, SC (US); Eric Martin Hahn, Aliso Viejo, CA (US); Walter Arthur Schreifels, Carlsbad, CA (US); Joseph Edward Smith, Rancho Mirage, CA (US); Patrick Gene Sullivan, Fountain Valley, CA (US)

(73) Assignee: Boral Lifetile, Inc., Newport Beach, CA (US)

( * ) Notice: Subject to any disclaimer, the term of this patent is extended or adjusted under 35 U.S.C. 154(b) by 0 days.

(21) Appl. No.: 09/432,325

(22) Filed: Nov. 2, 1999

Related U.S. Application Data

(62) Division of application No. 08/843,351, filed on Apr. 15, 1997, now Pat. No. 5,974,756.

(51) Int. Cl.[7] ..... E04D 1/00

(52) U.S. Cl. ..... 52/553; 52/519; 52/749.11; 52/745.19; 225/96.5; 225/94

(58) Field of Search ..... 225/4, 96.5, 93, 225/98; 52/553, 519, 745.19, 749.1, 749.11

(56) References Cited

U.S. PATENT DOCUMENTS

| | | | | |
|---|---|---|---|---|
| 4,030,386 | * | 6/1977 | Poetzsch | 83/4 |
| 4,646,955 | * | 3/1987 | Garrick | 225/3 |
| 4,733,676 | * | 3/1988 | Fisk | 131/290 |
| 4,742,945 | * | 5/1988 | Garrick | 225/2 |
| 4,782,869 | * | 11/1988 | Segerljung | 144/240 |
| 4,819,848 | * | 4/1989 | Hollander | 225/96 |
| 4,929,226 | * | 5/1990 | Focke | 225/4 |
| 4,988,027 | * | 1/1991 | Bremner | 225/2 |
| 5,580,303 | * | 12/1996 | Winslow | 452/1 |
| 5,974,756 | * | 11/1999 | Alvarez | 52/553 |
| 6,041,988 | * | 3/2000 | Shapiro | 225/1 |
| 6,098,862 | * | 8/2000 | Chakrabartl | 225/96.5 |

* cited by examiner

*Primary Examiner*—Beth A. Stephan
(74) *Attorney, Agent, or Firm*—Alston & Bird LLP

(57) ABSTRACT

A concrete or other roofing tile is provided which simulates wood shake roofing, and which may be used in either a direct deck or batten configuration. The simulated wood shake configuration includes an angled cut portion by means of a butt treatment, and also includes the use of an elongate medial slot which has a rectangular configuration.

20 Claims, 14 Drawing Sheets

BRUSH TREATMENT LEFT & RIGHT WITH FLASH

FLAH IS VARIEGATED CONTRASTED COLOR(S) PLACED INTEGRALLY AND RANDOMLY THROUGHOUT THE TILES.

BRUSH TREATMENT RIGHT

BUTT TREATMENT LEFT

BRUSH TREATMENT LEFT

BUTT TREATMENT RIGHT

BUTT TREATMENT LEFT

BUTT TREATMENT LEFT

BRUSH TREATMENT LEFT & RIGHT

PARTIAL BRUSH TREATMENT EXAMPLE 1
CAN BE ORIENTED LEFT OR RIGHT AND MAY BE ABSENT TOP OR BOTTOM

PARTIAL BRUSH TREATMENT EXAMPLE 2
CAN BE ORIENTED LEFT OR RIGHT AND MAY BE ABSENT TOP OR BOTTOM

ROOF TILE DESIGN AND CONSTRUCTION

This application is a division of Ser. No. 08/843,351 filed Apr. 15, 1997, U.S. Pat. No. 5,974,756.

TECHNICAL FIELD

This invention relates in general to roofing, and particularly relates to the use of light weight yet structurally sound concrete roof tiles which simulate wood shake or other types of roofing. The roof tile includes a "direct deck" configuration for use without batten strips, and a flat tile configuration which can be used with batten strips.

BACKGROUND OF THE INVENTION

In the field of roofing, it is known to provide roof tiles made of concrete, clay or other materials, in order that said tiles may be placed atop building structure to provide protection from the elements.

Various methods have been developed for producing concrete tiles, which can vary depending on the shape of the tiles in question. Typically, wet concrete is dispensed onto a moving pallet, and the pallet is passed under a roller and slipper to form and then shape the tile. A knife assembly cuts to length the tiles. The wet concrete is cured and then removed from the pallet to provide the complete tile.

Examples of tiles provided by the prior art are disclosed in several patents. Some of these patents include U.S. Pat. No. 5,406,766 to Nicholas, entitled "Multi-Color Concrete Tiles and Method and Apparatus for Making Same", U.S. Pat. No. 5,214,895 to Fefield, entitled "Roof Tiles", and U.S. Pat. No. 4,574,536 to Bamber, et al., entitled "Roof Tile".

Although present tile configurations may in some cases include advantages, there is always a need for improvement.

Therefore there may be seen a need in the art for a lightweight roof tile which simulates wood shake or other types of roofing, and which may be used in either a direct deck or batten configuration.

SUMMARY OF THE INVENTION

The present invention overcomes deficiencies in the prior art by providing a lightweight roof tile which simulates wood shake or other types of roofing, and which may be used in either a "direct deck" or batten configuration.

Therefore, it is an object of the present invention to provide an improved roof tile.

It is a further object of the present invention to provide an improved roof tile which is reduced in weight.

It is a further object of the present invention to provide an improved roof tile which has improved structural features.

It is a further object of the present invention to provide a direct-deck roof tile which can be temporarily placed on a roof of high inclination without yet being fastened.

It is a further object of the present invention to provide an improved roof tile which has improved ornamental features.

It is a further object of the present invention to provide an improved roof tile which has a reduced perceived visual scale.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Reference is now made to the drawings, in which like numerals designate like elements throughout the several views.

This detailed description, generally described, will first discuss a first embodiment of the present invention, including the structural as well as the surface treatment characteristics used therewith. A second embodiment will then be discussed which varies in its structural characteristics. The surface treatments will then be described in further detail, followed by installation and other discussions.

It should be understood that many of the features of the invention are interchangeable. For example, the top surface treatments can be used with either of the structural rib configurations without departing from the spirit and scope of the present invention.

The First Structural Rib Configuration (Direct Deck)

Reference is now made to FIGS. 1–8, which illustrate a first "direct-deck" (or "flat-roof") tile configuration 10 according to the present invention. Surface treatment variations on this embodiment are shown in configurations in FIGS. 12–19, and are discussed later in further detail.

Also as will be discussed later in further detail, the "direct-deck" tile configuration is one which can be installed on a flat roof surface, such as that which includes flat plywood or composite sheeting, although other underlayment configurations are contemplated under the spirit and scope of the present invention.

Figure 1:
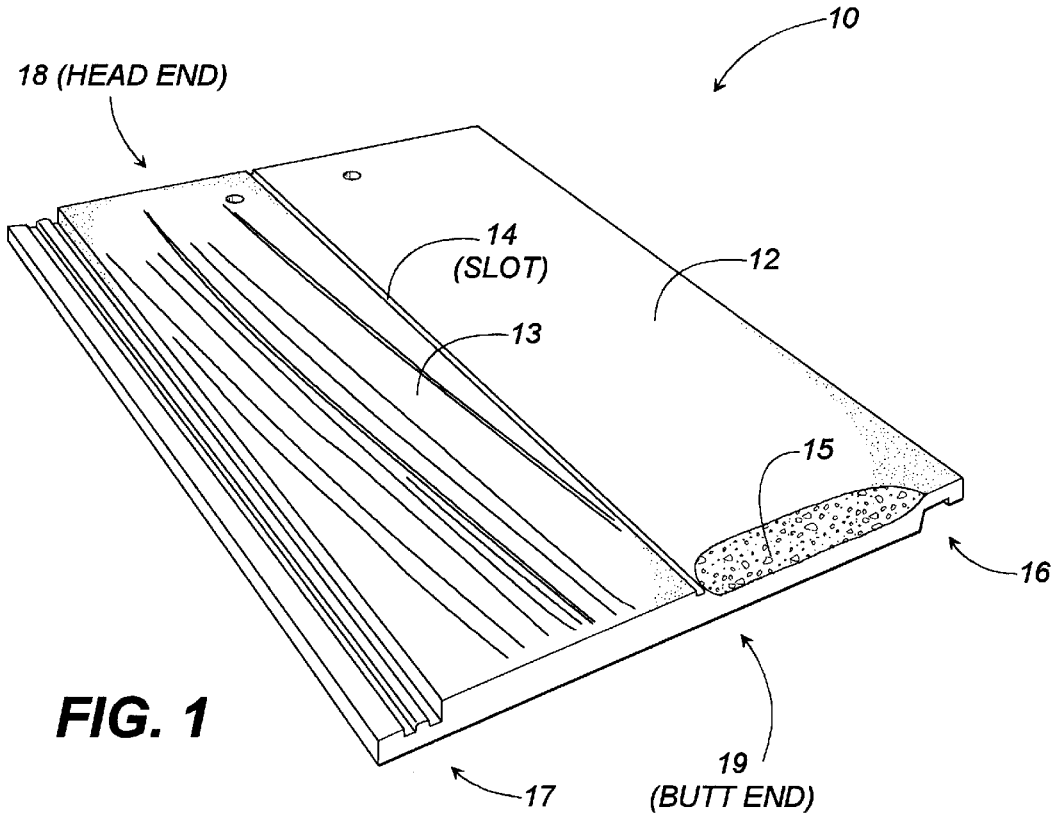
FIG. 1 is an isolated perspective view of a roof tile 10 according to the present invention viewed from above, said roof tile having a right "butt" treatment at 15, including brushing marks on its left shake portion face, and having a channel having a "rectangular" shape, including substantially vertical sides and a flat floor portion, which extends down a central area of the front face of the tile.

As shown in FIG. 1, the tile member 10 consists of two side-by-side shake portions, a right shake portion 12 and a left shake portion 13. The two portions 12, 13 are divided by a medial slot 14 which in a typical configuration is offset to one side, such that on of the right and left side portions appear wider than the other, although their lengths appear slightly dissimilar due to the butt treatment.

Figure 2:
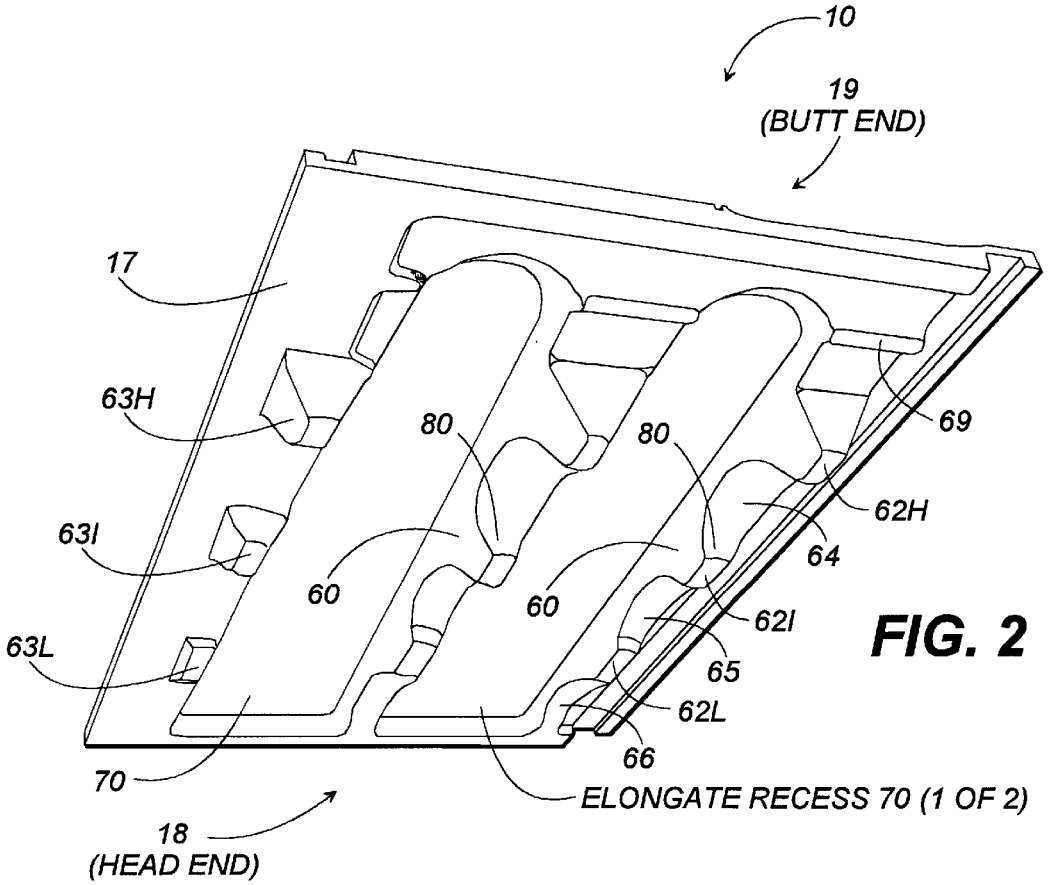
FIG. 2 is an isolated perspective view from below of the roof tile 10 of FIG. 1 according to the present invention.
Figure 3:
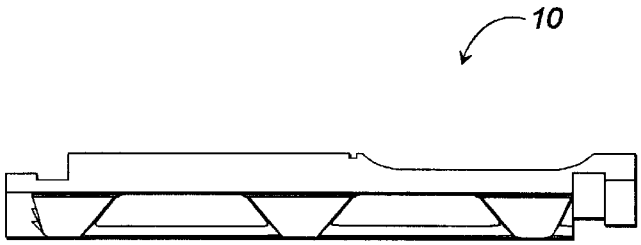
FIG. 3 is an elevational "butt" end view of the tile 10 of FIG. 1.
Figure 4:
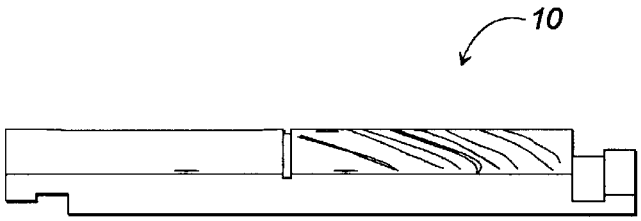
FIG. 4 is an elevational head end view of the tile 10 of FIG. 1.
Figure 6:
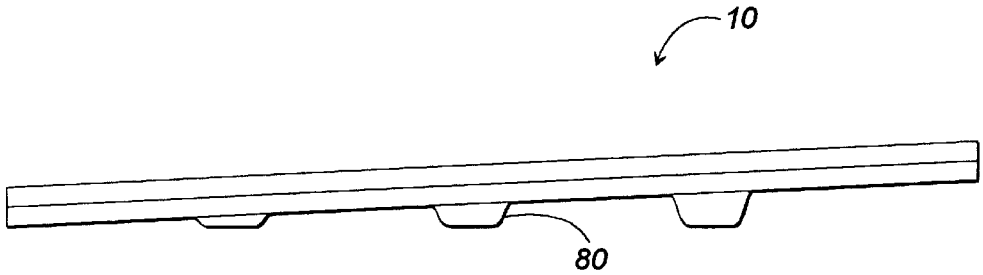
FIG. 6 is an elevational right side plan view of the tile 10 of FIG. 1.
Figure 7:
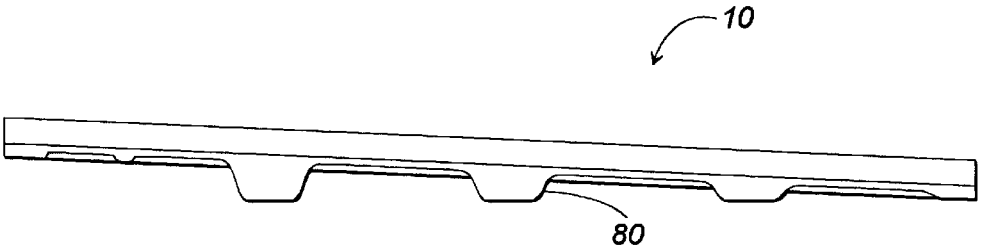
FIG. 7 is an elevational left side plan view of the tile 10 of FIG. 1.
Figure 5:
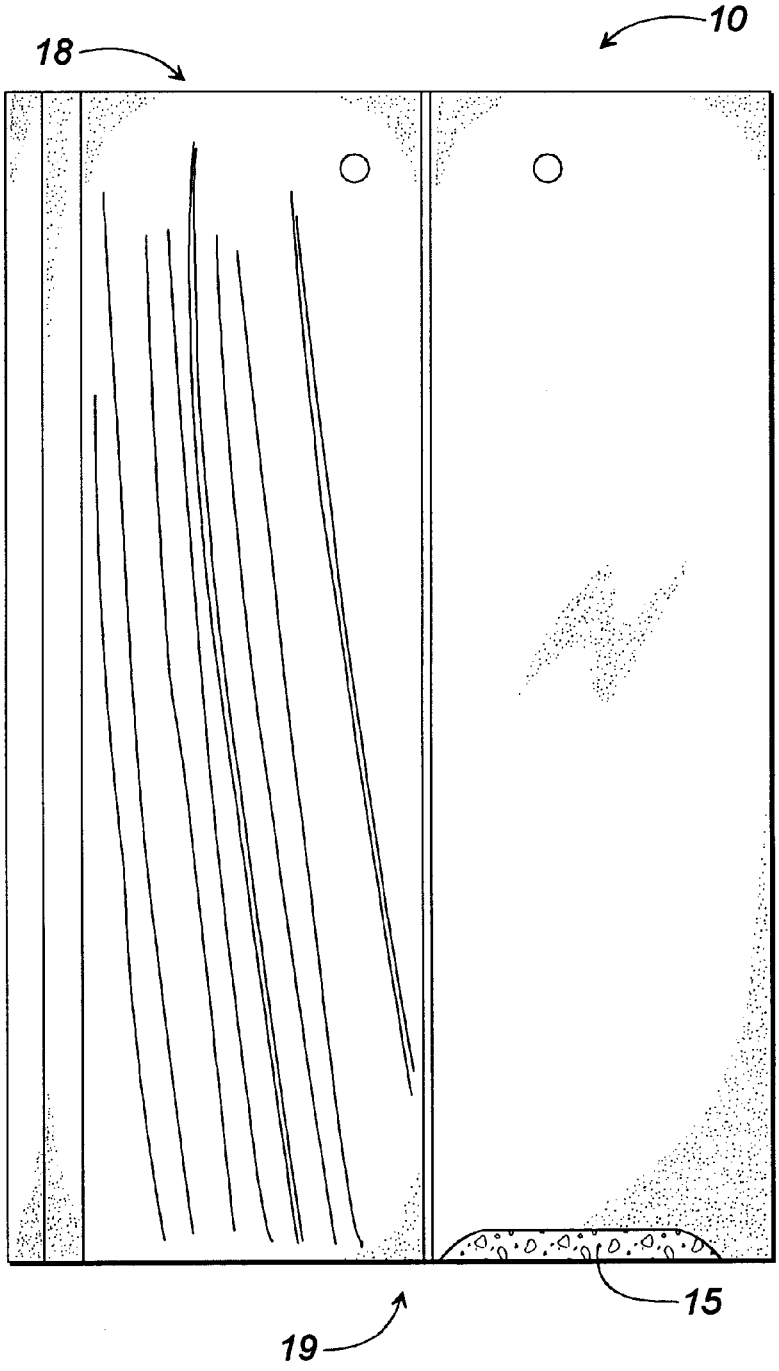
FIG. 5 is a top side plan view of the tile 10 of FIG. 1.
Figure 8:
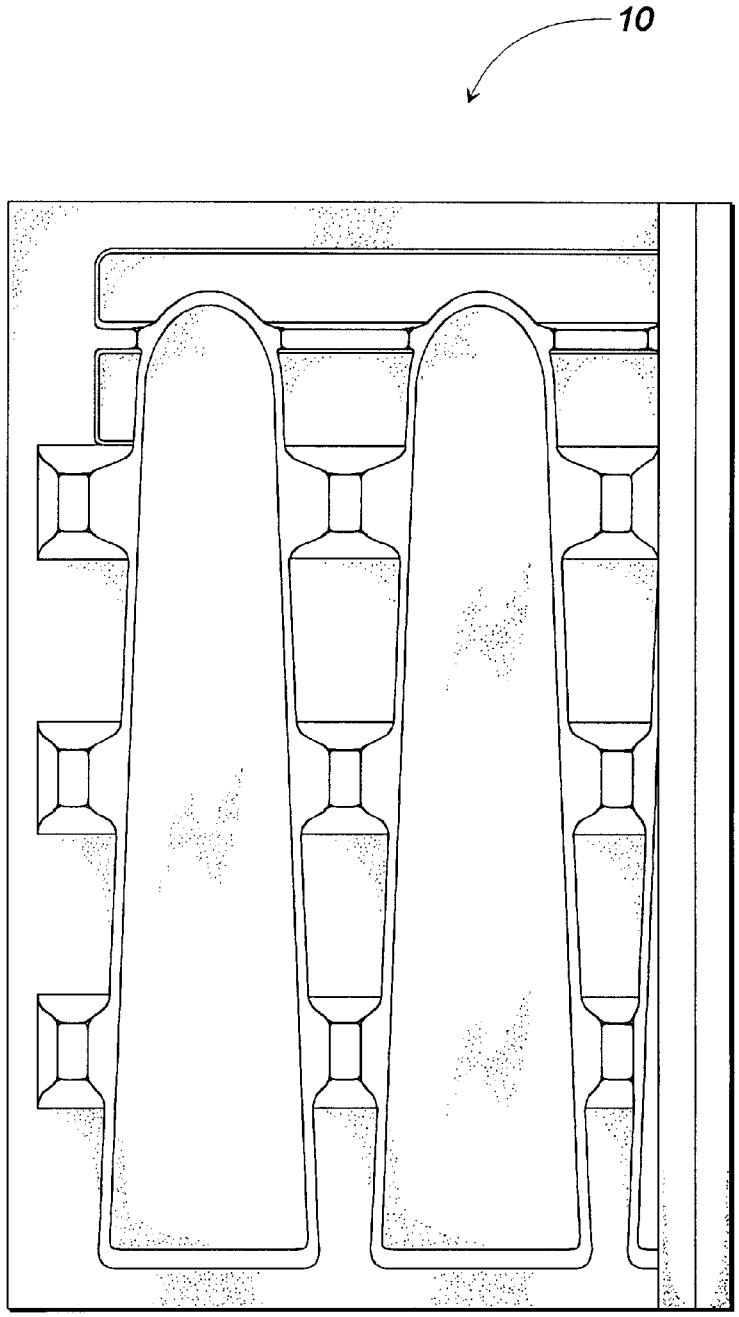
FIG. 8 is a bottom plan view of the tile 10 of FIG. 1.

Reference is now also made to FIG. 2. This view illustrates the use of two downwardly-directed substantially parallel longitudinal structural ribs 60. Each rib 60 has scalloped portions 64, 65, and 66, such that support nodules 62H, 62I, and 62L (which may also be referenced as "pillars") are defined. The support nodules 62H, 62I, and 62L are configured to contact a supporting surface such as a plywood or other suitable support structure with suitable underlayment such as felt. These nodules are at different heights, with nodules 62H being the "highest" nodules, although when their associated tile is installed they extend downwardly. Nodules 62I are of intermediate height, and nodules 62L are the lowest nodules.

The ends (or tips) of these nodules, as well as for nodules 63 discussed later, all lie in substantially the same plane, and as noted above will all be in contact with a supporting surface when installed. This common plane is inclined preferably at an angle from the upper planar surface of the tile, such that the tile can be installed in an overlapping configuration with other tiles such that the head ends 18 of the tiles are overlapped and covered by the butt ends 19 of tiles in a higher course.

Referring back also to FIG. 1, the tile member 10 includes side engagement portions that allow the tiles 10 to engage and interlock with laterally adjacent tiles. as known in the art. In the configuration shown in FIG. 1, the tile member includes an upwardly-directed side engaging portion 17, which is configured to engage and interlock with a downwardly-directed side engaging portion of an adjacent tile member, which is shaped similar to the downwardly-directed side engaging portion 16.

In addition to the nodules 62H, 62I, and 62L, three other nodules 63H, 63I, and 63L extend downwardly from the upwardly-directed engaging portion 17, which has a thickness which allows it to likewise function as a rib. This portion 17, as shown best in FIG. 2, is separated by elongate recesses 70, one of which extends between the two ribs 60, and the other of which extends between the engaging portion 17 and the centrally-located rib.

Figure 20:
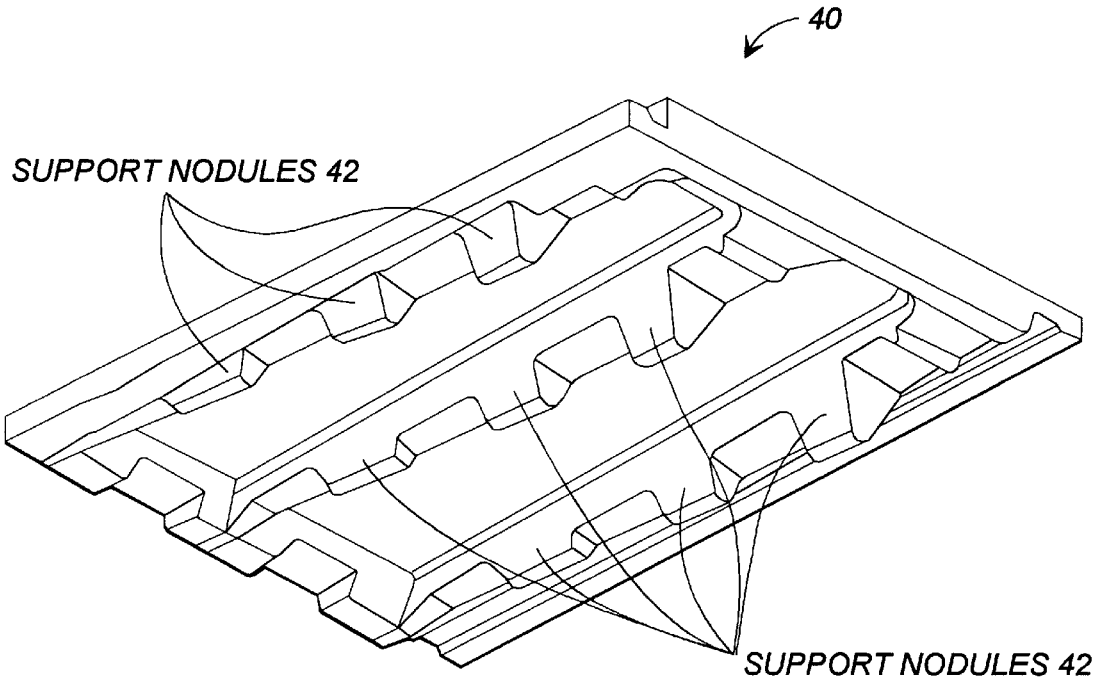
FIG. 20 is an isolated perspective view from below of a roof tile 40 according to the present invention, showing alternate support nodule configurations.

Reference is also made to an alternate direct deck tile configuration 40 shown in FIG. 20. This configuration likewise includes a plurality of support nodules 42.

Under one embodiment of the present invention, a flat shoulder portion 80 is provided to the intermediate-height nodules 63I, 62I. This is to allow a batten strip (not shown) to be used to allow installers to "hang" and align the tiles 10 on the batten strips prior to being fastened to the supporting surface. It should be understood that in this application (in which the battens pass under the middle portion of the tiles) the batten strips are used for this "hanging" feature only, and not to provide the traditional structural support provided by battens attached underneath the "head" portions of tiles. Such a configuration is advantageous when roof surfaces of relatively high inclination are encountered.

An alternate flat roof tile structural configuration is also contemplated under the present invention. Under this configuration (not shown), there are no scalloped cavities in the support ribs, such that they resemble three inclined ramps. The bottom surfaces of these support ribs contact the planar supporting surface of the roof therebelow. Under this alternate configuration, the tile is continuously supported along the anterior-posterior axis, that is., the tile is supported along its longitudinal axis.

It should also be understood that any of the ribs could be solid ribs (without the scalloped portions), including the centrally located rib. Such a configuration would provide continuous support over a significant longitudinal span of the tile, although the above-referenced hanging feature would not be allowed.

The Second Structural Rib Configuration (Flat Tile)

Figure 9:
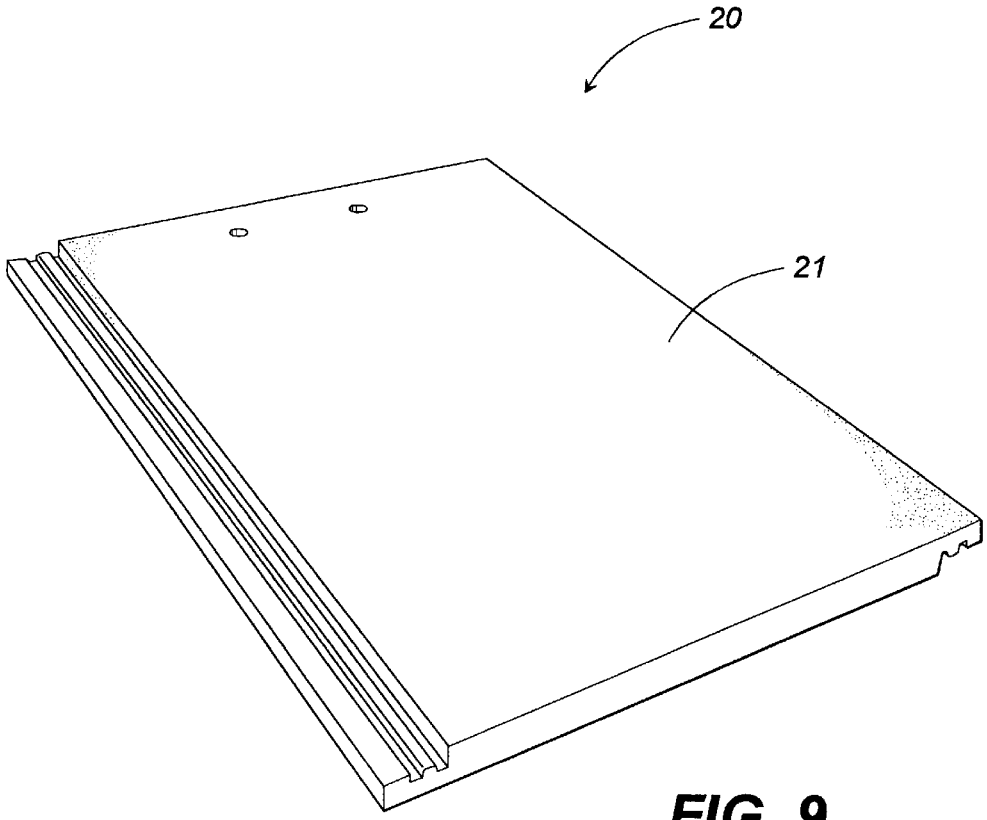
FIG. 9 is an isolated perspective view from above of a roof tile 20 according to the present invention, said roof tile having an upper surface capable of including surface treatments similar to that shown in FIG. 1.
Figure 10:
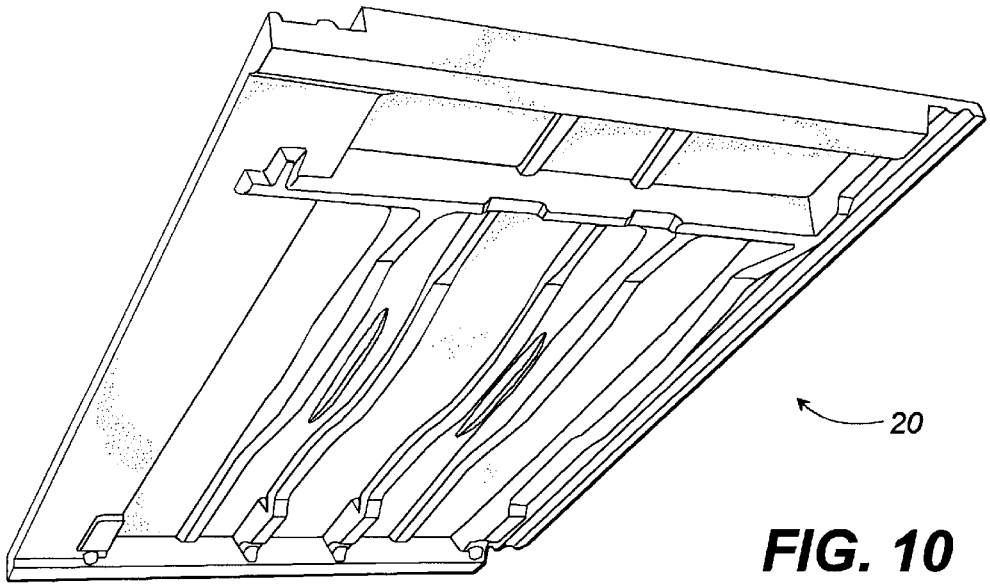
FIG. 10 is an isolated perspective view from below of the roof tile 20 of FIG. 9.
Figure 11:
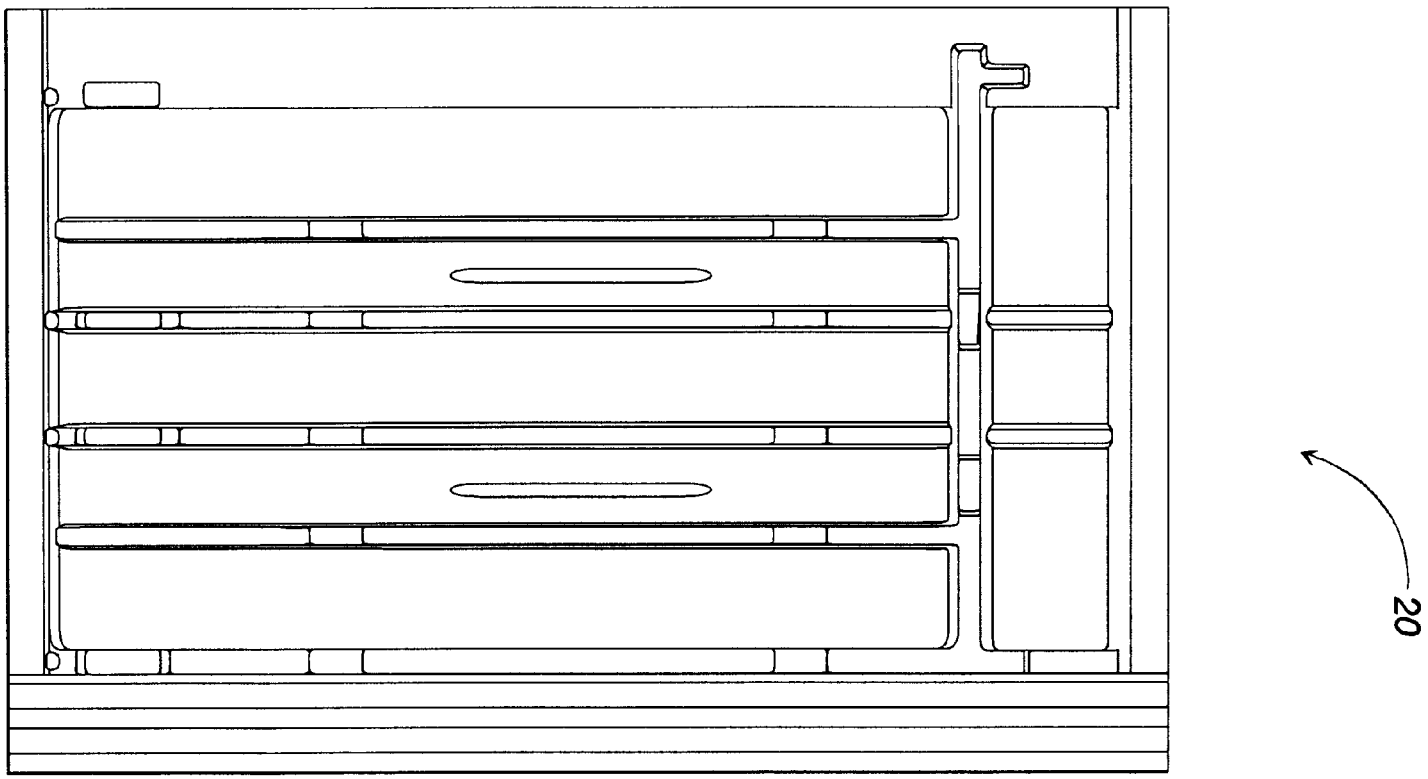
FIG. 11 is an isolated bottom plan view of the roof tile 20 of FIG. 9.

Reference is now made to FIGS. 9–11, which illustrate a "flat tile" configuration according to the present invention which can be used with batten strips. As noted above, the upper surface treatments such as the brushing, flashing, and cleaving (which will be discussed later in further detail) can be used in conjunction with a tile including this second structural rib configuration.

This configuration illustrates the use of various functionally-oriented ribs and recesses which provide structural support while providing a lighter weight tile.

The Top Surface Treatments Generally

FIGS. 12–19 show various upper surface treatments of a roof tile according to the present invention. These upper surface treatments includes the use of a medial notch such as 34, flashing, brushing, and butt cleaving.

As discussed above, essentially the tiles shown in FIGS. 12–19 take the form of two shakelike "segments", separated by an offset elongate medial slot 34. This slot (also possibly known as a trough) extends substantially along the length of the tiles, and is substantially rectangular, in that its side walls are substantially perpendicular to the bottom floor of the upwardly-oriented trough although some slight draft from vertical can be provided if desired.

This rectangular slot configuration provides an improvement over the prior art, in that it takes advantages of daylight orientation to provide a distinct "line" providing to the eye a separating feature between the two halves of the tile. It has been determined that V-shaped notch designs in the prior art do not provide the desired amount of light absorption to create the desired separation between the two shakelike portions. The shape provided by the notch of the invention provides the effect to the observer of showing two separate, elongate parallel wood shakes oriented side by side. Due to the offset of the slot, one shake appears wider than the other.

As may be understood natural wood shakes may have different characteristics as would be typical in such objects. As described elsewhere, such different characteristics can include the butt cleaving described above, the contrasting colors provided by the flashing, or the effect of "grain" simulated by the brush treatment.

Figure 12:
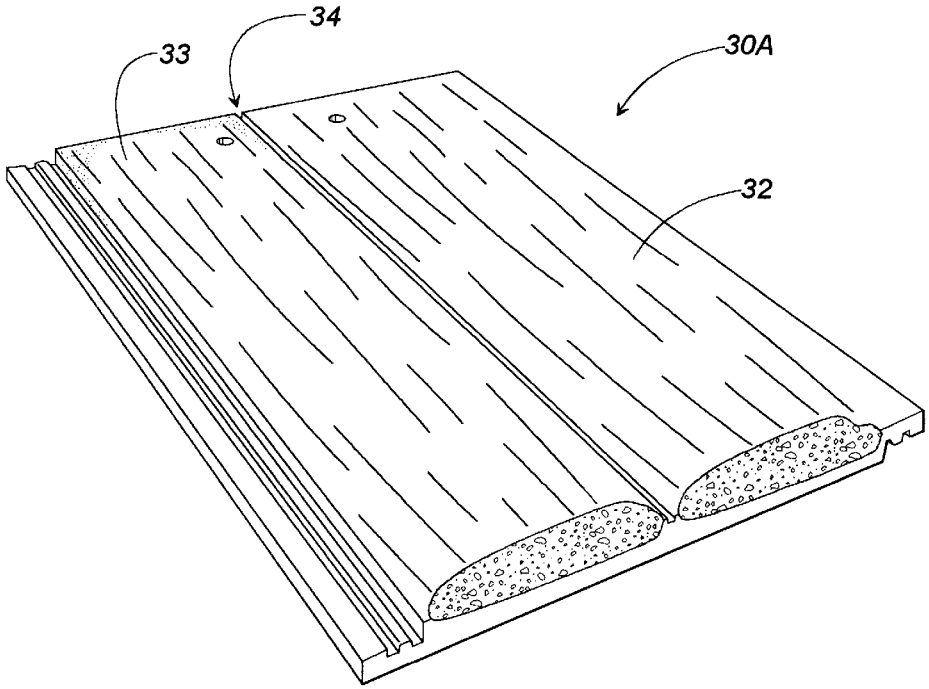
FIG. 12 is an isolated perspective view from above of a roof tile 30A according to the present invention, having left and right "flashing" treatments, and left and right treatments.
Figure 13:
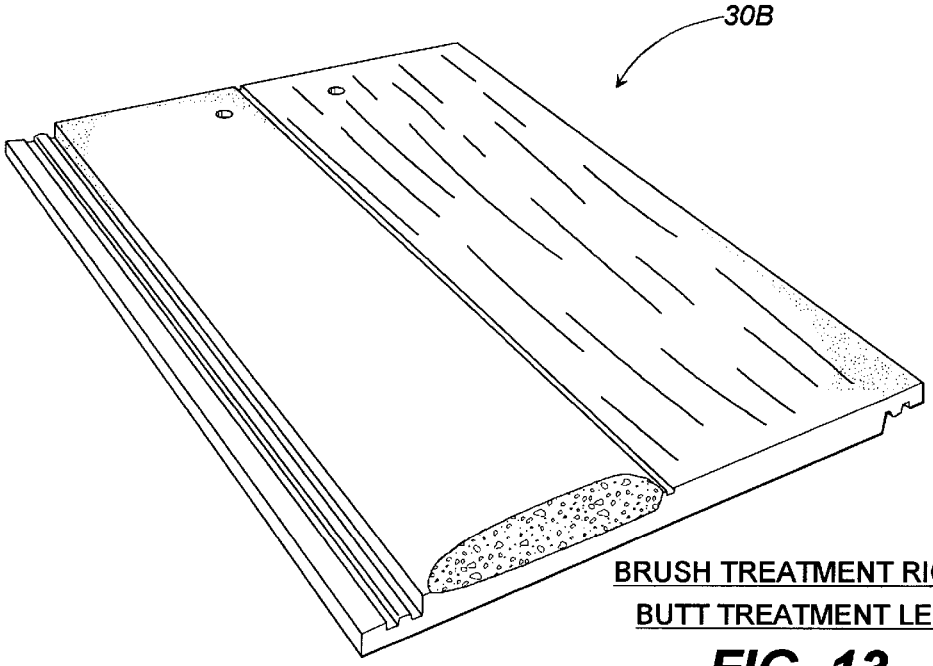
FIG. 13 is an isolated perspective view of a roof tile 30B according to the present invention having a "right" brush treatment and a left "butt" treatment.
Figure 14:
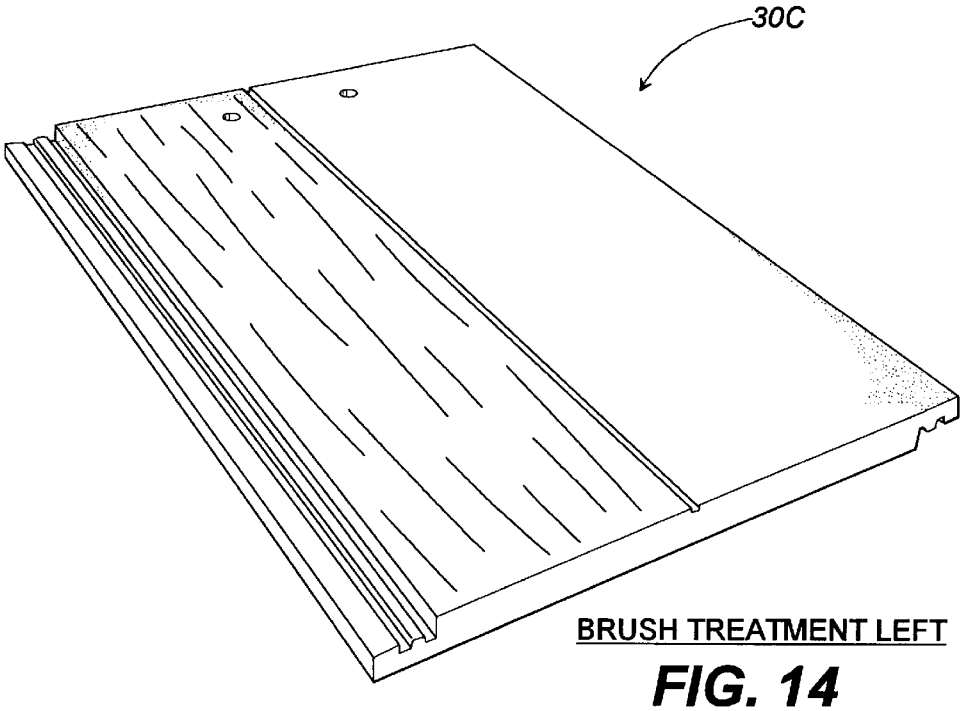
FIG. 14 is an isolated perspective view of a roof tile 30C according to the present invention, having a left brush treatment only.
Figure 15:
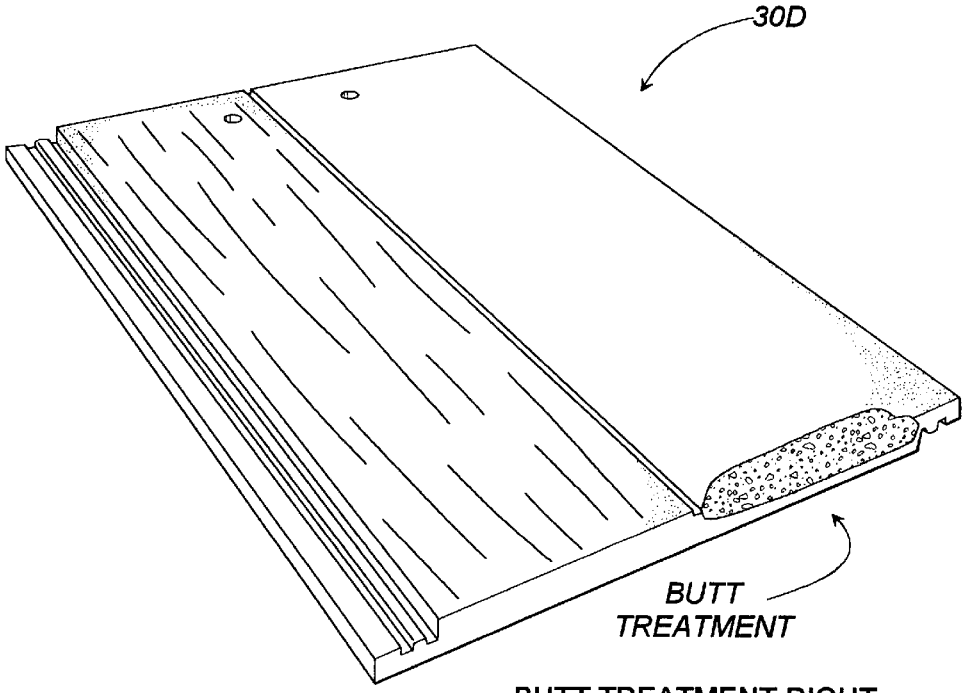
FIG. 15 is an isolated perspective view of a roof tile 30D according to the present invention, having a right butt treatment and a left brush treatment.
Figure 16:
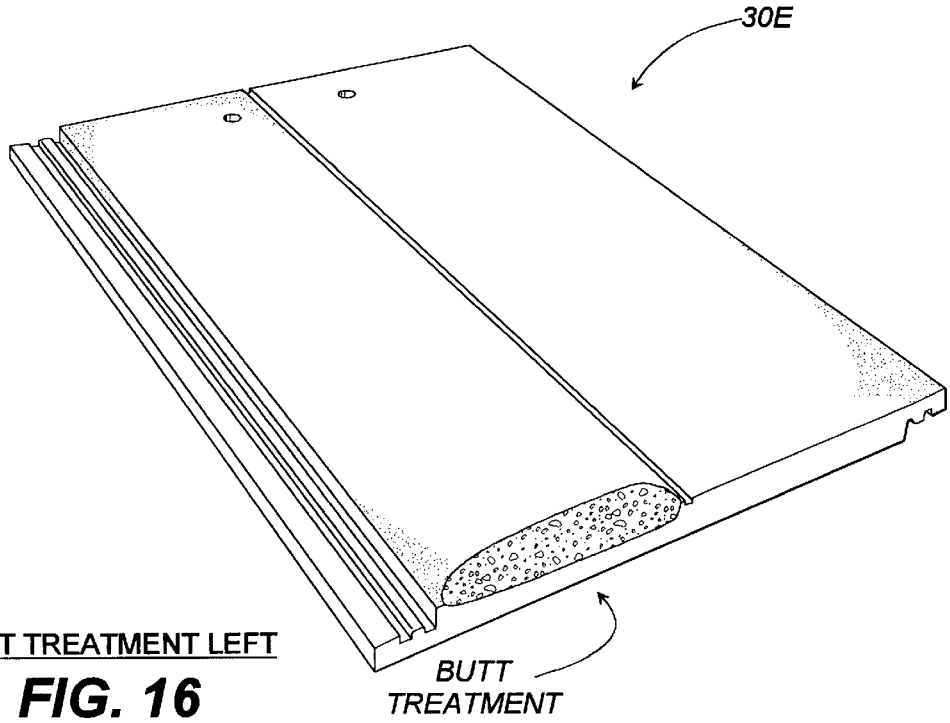
FIG. 16 is an isolated perspective view of a roof tile 30E according to the present invention, having a left butt treatment only.
Figure 17:
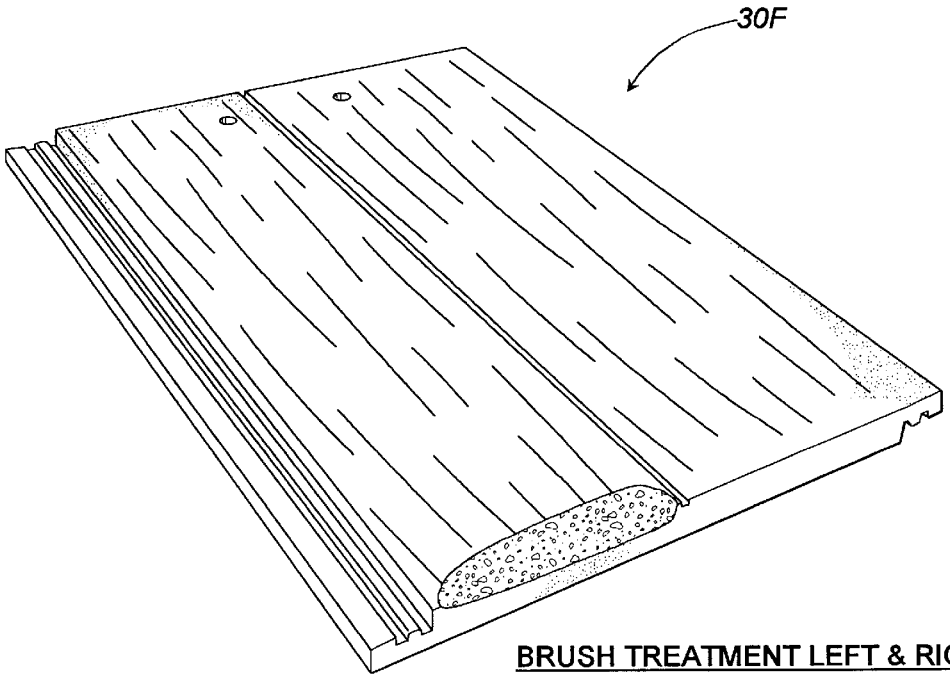
FIG. 17 is an isolated perspective view of a roof tile 30F according to the present invention, having a left and right brush treatment.
Figure 18:
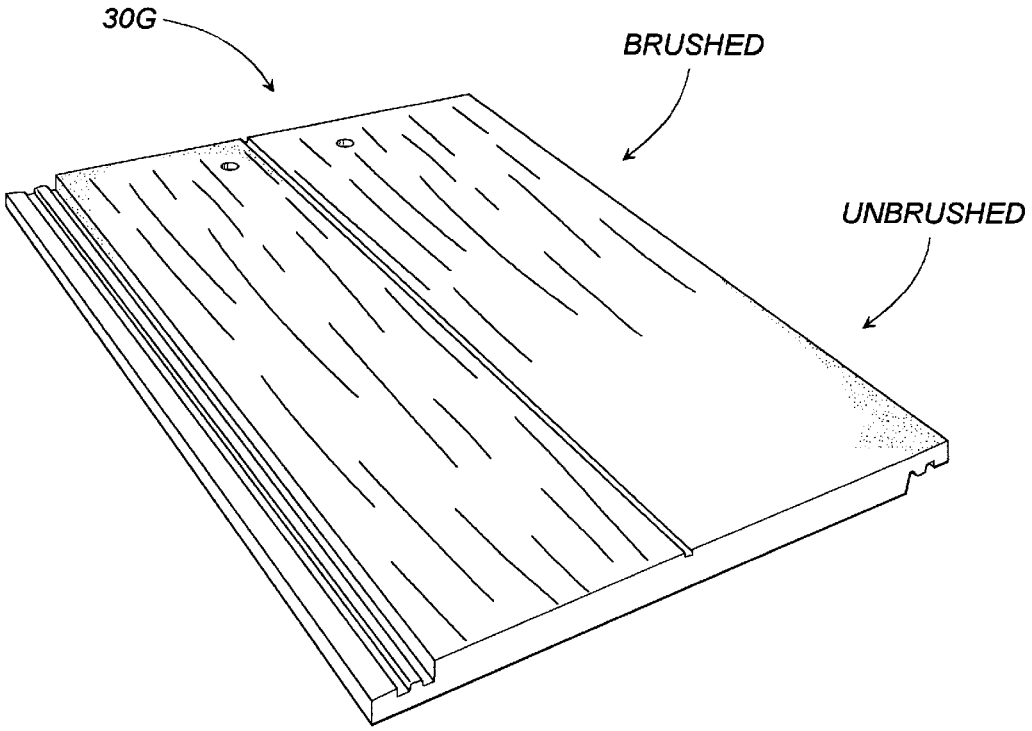
FIG. 18 is an isolated perspective view of a roof tile 30G according to the present invention, having a partial brush treatment. This is only one example, as the brush treatment can be oriented left or right and may be absent top or bottom.
Figure 19:
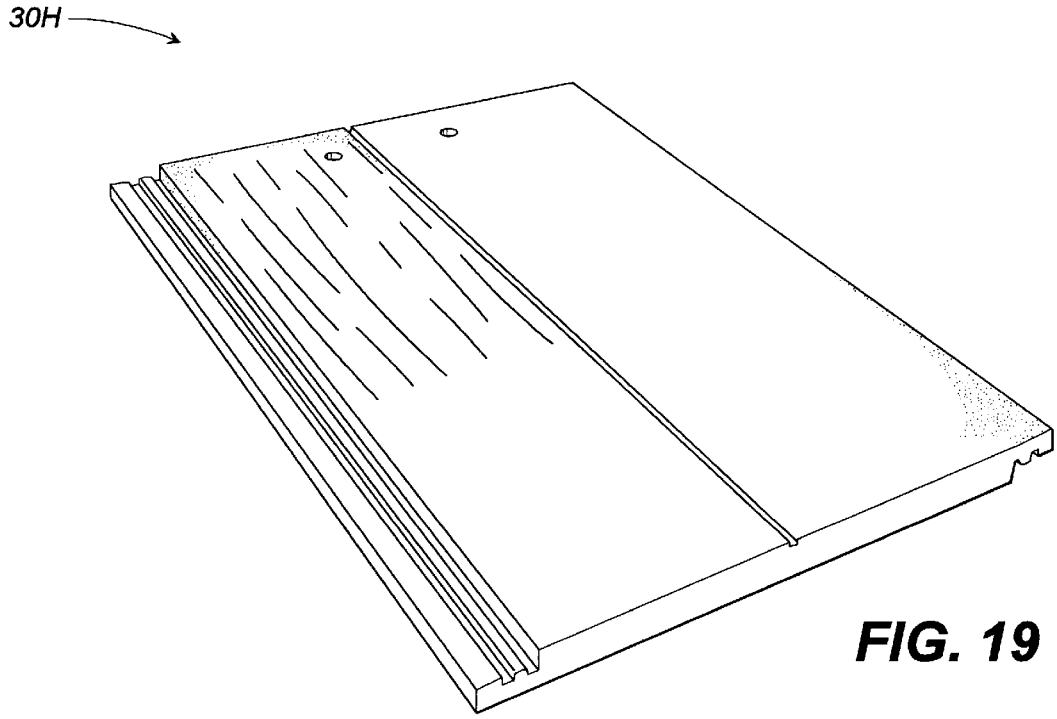
FIG. 19 is an isolated perspective view of a roof tile 30H according to the present invention, having a partial brush treatment. It may be noted that the partial brush treatment may be oriented left or right and may be present top or bottom.

With respect to flashing, FIG. 12 is the only one which shows "flashing", which can be variegated contrasting colors placed integrally and randomly throughout the tiles as known in the art.

With respect to the butt treatment which is referenced as "cleaving", FIGS. 1, 12, 13, 15 and 16 illustrate roof tiles according to the present invention which include an angled cut portion. For example, in FIG. 12, butt treatment is provided to both the left and right halves of the roof tile. This butt treatment, intended to imitate a cleaved butt edge of a wood shake, is provided by severing a portion of the left or right butt end of the tile as described below. This feature creates the appearance of variation in the relative lengths of the left and right segments of the tiles.

Two types of cleaving processes are contemplated under the present invention, "in-line" cleaving, and "transverse" cleaving. In both cases, the cleaving is accomplished with a moving cutting member being part of an electromechanical assembly.

When receiving their butt treatments, the tiles are moving on along the conveyor line at approximately 100 tiles per minute, which translates to approximately 1700 inches/min. for 17 inch tiles. As may be understood, the placement of the cuts on the butt portions of the tiles is important, as there is a desire to avoid cutting into the edge channel.

Figure 21:
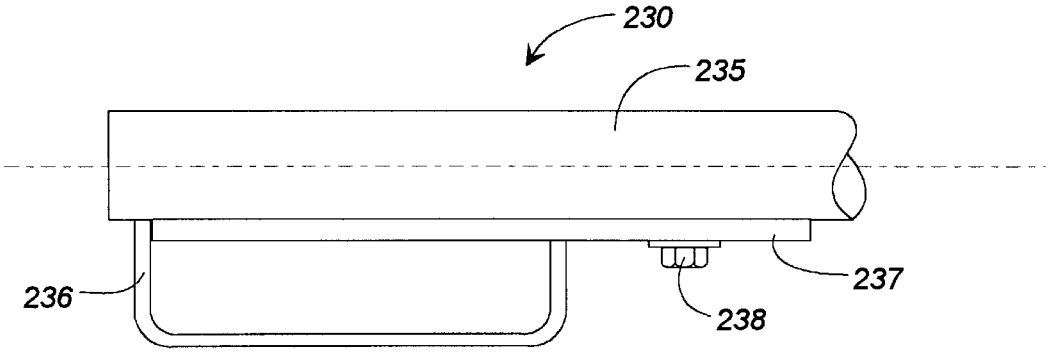
FIG. 21 is a front partial view of a portion of a cleaving mechanism 230 according to the present invention.
Figure 22:
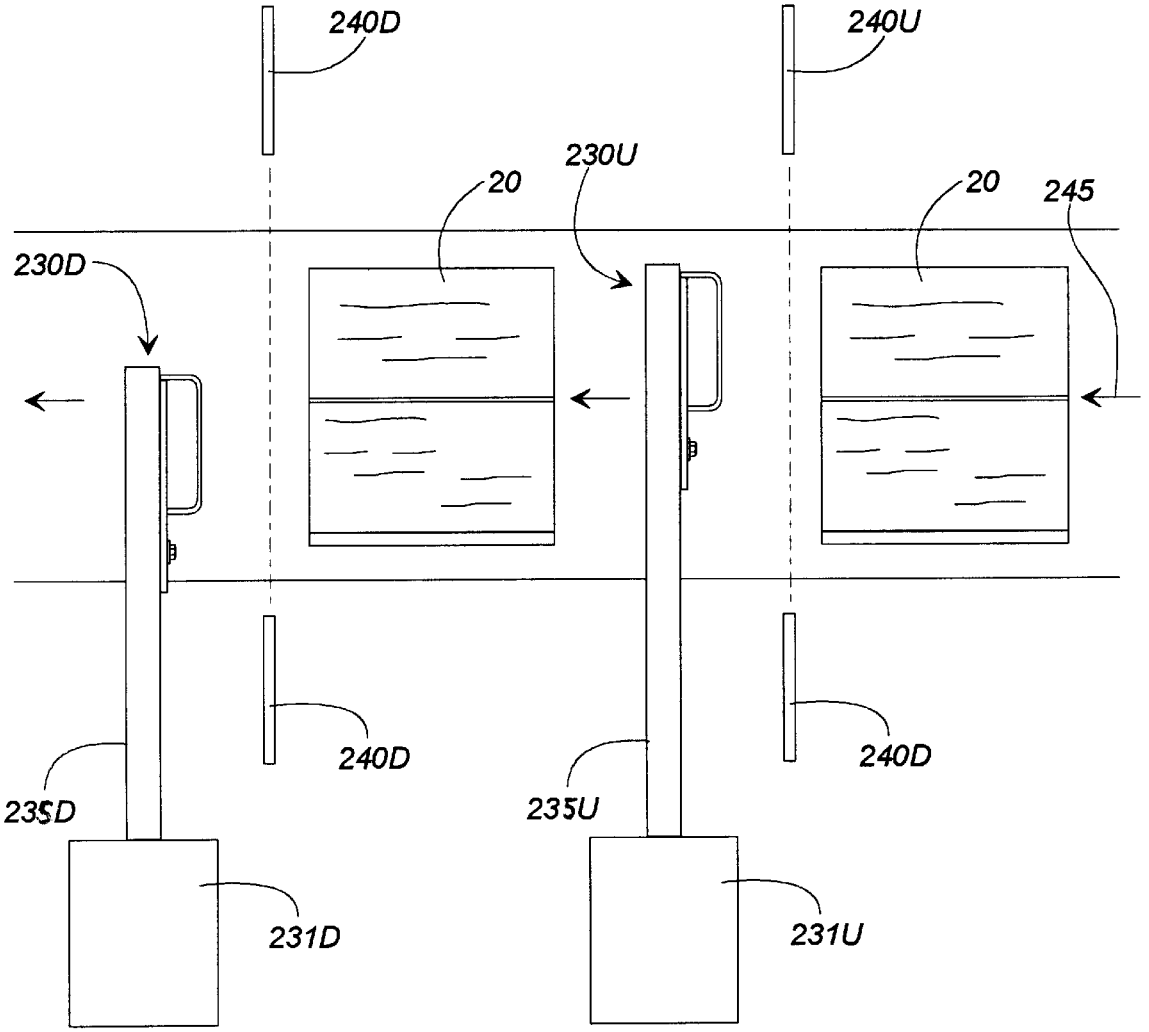
FIG. 22 is a top plan system view of a pair of cleaving mechanisms 230U, 230D, situated over a path 245 of conveyed tiles 20.

To practice "in-line" cleaving, as shown in FIGS. 21 and 22, a cutting or "cleaving" apparatus 230 including a cleaving member 235 is positioned relative to the conveying axis of a tile transport conveyor such that the cutting axis of the cleaving member lies across the path 245 of the tiles such as 20 being conveyed. In FIG. 21, a portion of a cleaving assembly 230 is shown. The cutting assembly 230 includes a rotatable shaft 235, a cleaving member 236, an adjustment bar 237, and a securing fastener 238.

The cleaving member 236 is substantially U-shaped in the preferred embodiment, being formed out of a length of bar stock having a substantially rectangular transverse cross-section, although a bevel is provided as described later to define a cutting edge. The U-shaped cleaving member 236 is rigidly attached to the adjustment bar 237. The cleaving member 236 can be laterally adjusted relative to the path 245 of the tiles by selectively loosening and tightening fastener 238, which extends through an elongate slot (not shown) and the adjustment bar 237, and threadably engages the rotatable support shaft 235.

Referring now to FIG. 22, the use of two cleaving assemblies 230 is illustrated, with an "upstream" cleaving assembly designated as 230U, and a downstream cleaving assembly designated 230D. As may be seen, the cleaving assembly 230U is positioned to cleave the "right" portion of the tiles 20 as they pass thereunder, and the downstream cleaving assembly 230 is configured to cleave the "left" portion of the tiles 20 as they pass thereunder.

As shown only in FIG. 22, a pair of sensor units 240 are used to sense when the tiles 20 pass thereby. In the preferred embodiment, two pairs of sensing units are used, an "upstream" pair of sensing units 240U, and a "downstream" pair of sensing units 240D. The sensor units provide a signal corresponding to the "gaps" recognized between the ends of the tiles as they lie on the conveyor path 245.

It should be understood that as the tiles such as 20 are lined up fairly closely together when placed along the conveying path, it is important that the timing of the cut is controlled. Therefore, the sensing members are placed just upstream of their associated cleaving members.

The upstream and downstream cleaving assemblies 230U, 230D, respectively, are selectively indexed by drive units 231U, 231D, respectively, each of which includes a motor, gearbox, clutch, and drive belts as described in further detail below. The shaft 235 of the cleaving assembly 230 is selectively indexed to rotate a single revolution about the longitudinal axis of the shaft 235, such that the U-shaped cleaving member 230 can selectively engage the butt end of the tiles, and cleave them as shown in the drawings (see for example FIG. 1). After the cutting process, compressed air can be used to blow the cut debris off.

It should be understood that it is an important feature of the present invention to provide such alternating butt treatments, which, assuming the tiles are suitably mixed prior to being installed, provide a perceptively random butt treatment which in addition creates a subtle appearance of variable lengths of left and right tile segments as viewed by the ordinary observer. Under one preferred embodiment of the present invention, the tiles received butt treatments in an "alternating" pattern; that is, a first tile receives a "right" treatment, a second tile receives "left" butt treatment, followed by a third tile which receives a "right" butt treatment, followed by a fourth tile which receives a "left" butt treatment. This is readily provided by a PLC which can be programmed to provide such a result.

Figure 23:
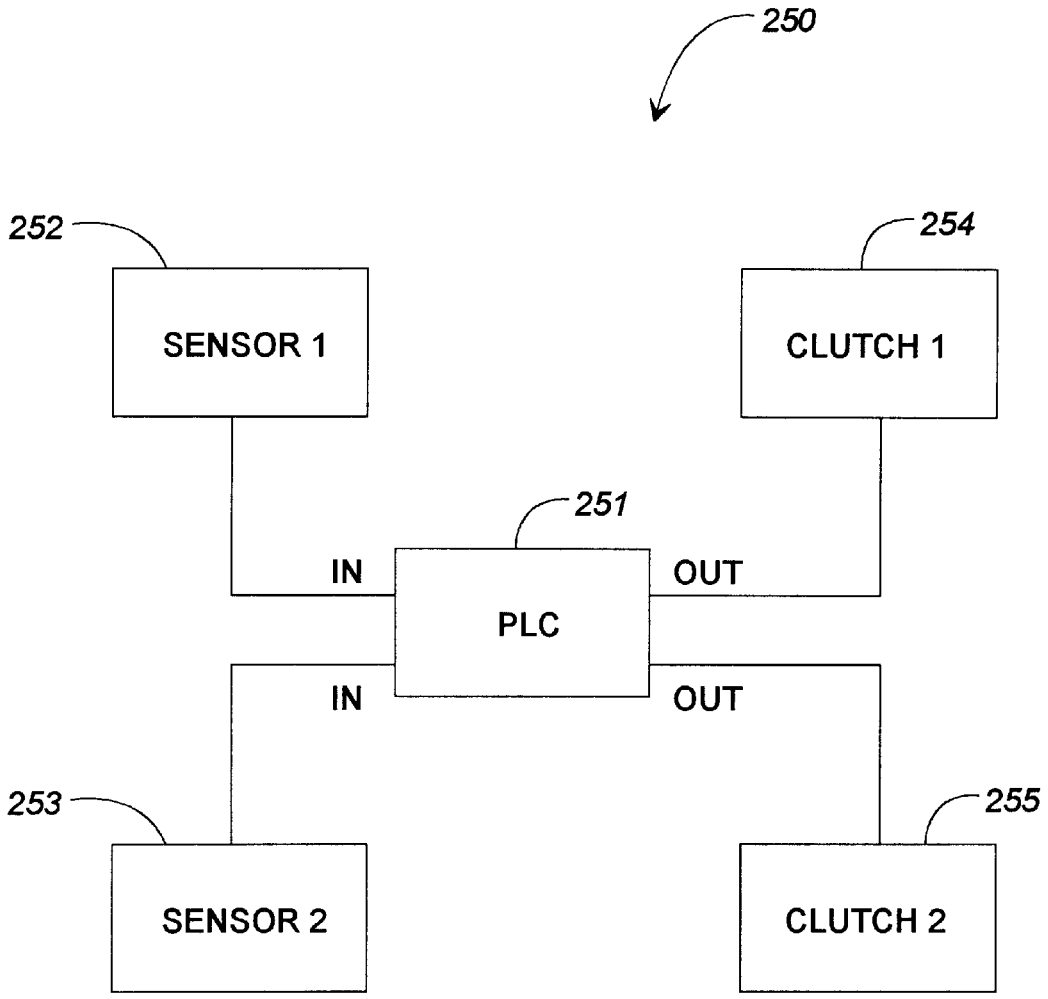
FIG. 23 is an illustrative signal control schematic diagram.

Reference is now made to FIG. 23, which illustrates a general control layout of one embodiment of the present invention. Such a control layout includes a Programmable Logic Controller (PLC) 251. This PLC 251 is fed signals from a first sensor pair 252 and a second sensor pair 253. The PLC 251 provides signals out to corresponding first and second clutches 254, 255. These first and second clutches are configured to engage upon instructions from the PLC, such that as tiles break the signal beam of the associated sensor, the clutches are engaged after a predetermined delay which presumes a predetermined conveyor speed.

Figure 25:
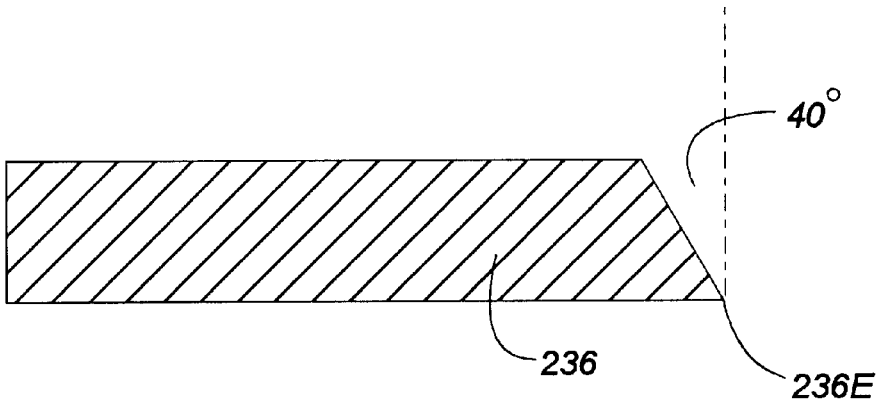
FIG. 25 is a side cross-sectional view of the lower, cutting, portion of the cleaving member 236.

Although other materials and components could be used without departing from the spirit and scope of the present invention, the shaft 235 is one embodiment approximately 1 7/16 inches in diameter, and the cutting edge 236E (see FIG. 25) is spaced from the substantially horizontal centerline of the shaft approximately 2 inches. The U-shaped cutting member is in one embodiment composed of spring steel, having a transverse cross section approximately ⅛ thick by 1½ inches wide. The cutting face of the U-shaped cutting member includes a bevel, as shown in FIG. 25, which is beveled back approximately forty (40) degrees, to form a cutting edge 236E.

The motor used is a ¾ horsepower, 3 phase motor running at approximately 1740 RPM. The motor drives a 5:1 reduction gearbox having an output shaft. The output shaft of the gearbox supports a pair of 6" diameter pulleys which drive a second pair of pulleys, having 6.6 inch diameters, through a pair of redundant pulley belts. The second pair of pulleys are mounted to the input shaft of a clutch assembly likewise including an output shaft. Upon the receipt of a low-voltage signal, the normally disengaged clutch mechanism is configured to engage for one rotation of its input shaft, which causes one rotation of the clutch mechanism's output shaft. Upon the rotation of both shafts, the clutch then automatically disengages to cause the clutch mechanism's output shaft to stop, awaiting the next signal from the PLC 251. The clutch mechanism's input shaft continues to rotate, as do the aforementioned pulleys, belts, and motor rotor.

The clutch is a Werner #308-17-125 model, although other configurations are contemplated under the spirit and scope of the present invention. The clutch, once engaged, allows its output shaft to rotate one revolution at its input shaft speed.

The PLC is such as those manufactured by Allen-Bradley, series Micrologic 1000, model no 1761L16 (with 16 I/O's).

The sensors are a matched pair of optical sensors, with one sensor emitting a light signal and the other recognizing the presence of same.

As noted above, the PLC is configured to cause every other tile to be cut on its right side, and the remaining, alternating, tiles to be cut on their left sides.

Figure 24:
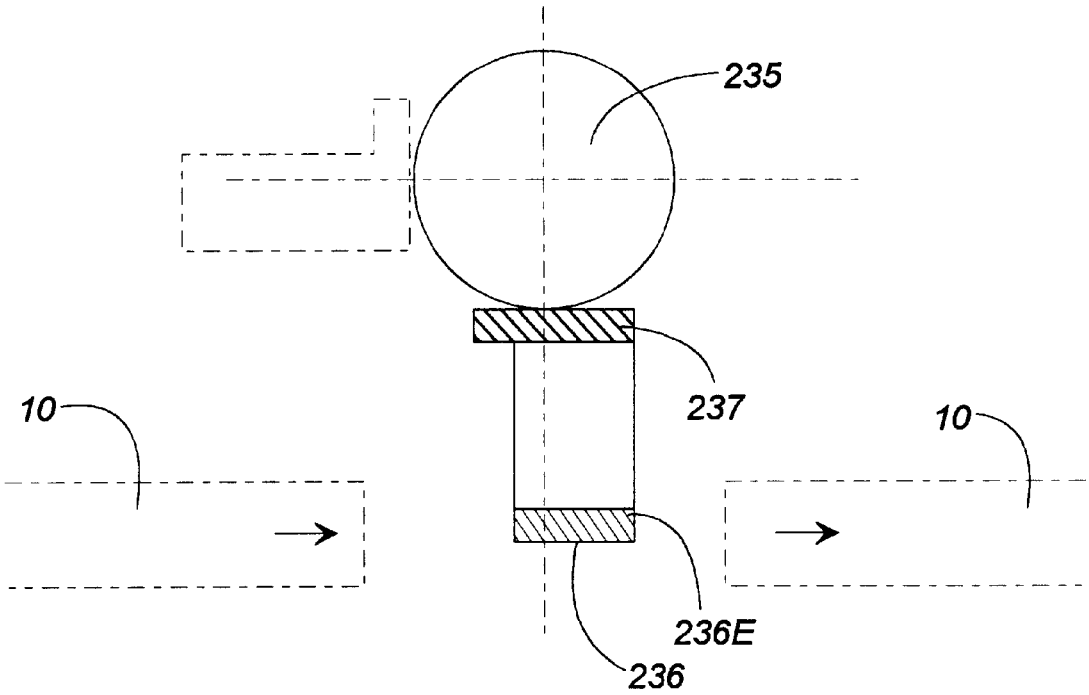
FIG. 24 is a side illustrative view showing the cutting path of a cleaving member 236 as it performs its cleaving function.

When the tiles are on the conveyor, they are spaced apart a distance ranging from ½ inches to 2 inches. As noted above, the conveyor line is running at approximately 100 tiles per minute, and the cutting edge moves at approximately twice that speed. Under the configuration according to the present invention, as shown in FIG. 24 the cutting edge just barely misses cutting into the head end of the next downstream tile.

Alternatives to the above cleaving process are possible. In an alternate in-line embodiment, use could be made of a flat plate attached to a PLC-controlled assembly that performs a downward or "guillotine" stroke imparting a cleaving followed by a motion upward and away from the path of the moving tile to an original starting position from which this process may be repeated. A configuration could also be used which includes the use of a flat plate attached to a selectively rotatable shaft such as described above. This plate could be mounted to the shaft by suitable fasteners such that one planar surface is in contact with the circumferential surface of the shaft, although a flat mounting spot could also be provided if so desired. The working edge of the blade could be flat or irregular, depending upon the surface treatment desired. It should be understood that various cutting blade configurations are contemplated; irregular, blunt to sharp cutting blade edges may be employed to impart rough to smooth surface texture to the treated butt portion.

To practice "transverse" cleaving, a cutting member is positioned relative to the conveying axis of a tile transport conveyor such that the cutting axis of the cutting member lies in a plane perpendicular or "transverse" to that of the conveying axis.

The cuts made by the rotating cutting member 236 are typically between the range of a cut 1 inch long and ¾ inches deep, to a next to negligible cut, depending upon the timing and tolerances involved.

With respect to brushing, FIGS. 13, 14, 15, 17, 18 and 19 are figures which illustrate roof tiles all according to the present invention which include "brushing". Brushing, a post extrusion process, is accomplished by randomly applying brushlike bristles of broomstraw, metal, or other materials of similar dimension and effect as part of an electromechanical assembly.

As it has been found that the presence of a rough surface on the top surface of tiles absorbs more light than the same surface with a smooth treatment, brushing has been found to have an advantageous effect in reducing the visual scale of the tiles as placed.

In one preferred embodiment, a pair of brush segments (not shown) are used to provide brush marks on the decorative surface of the tiles. Each of the brush segments are driven by double-acting pneumatic cylinders which have approximately one and one-half inch strokes.

A PLC (not shown) controls the movement of the brush segments. In one preferred embodiment, the right brush segment can be lowered into its brushing position for six seconds, the left brush can be lowered into its brushing position for six seconds, both brushes can be lowered into their brushing positions for twelve seconds, and both brushes can be raised into its brushing position for six seconds. This sequence can then be repeated. There is no input to the brush control PLC; the above series is independent of the flow of the tiles along the conveyor.

The brush segments include steel bristles each having a rectangular cross section having the dimensions ⅛ inches by 1/32 inches by 3 inches long. The ends of the bristles are flat, and are oriented in various directions due to the tendency of the bristles to twist.

All of the above features (flashing, butt treatment and the brushing) in combination and randomly applied achieve a reduction of nearly a factor of two of the apparent size of individual shapes. This reduction in scale of the tile shapes is further enhanced by random differences in length, surface texture, and color. In other word, these features overcome a common objection to the visibility of the larger full-tile dimensions.

Installation

To install the first preferred embodiment, as noted above, no batten strips will be required to provide the angled orientation of the tile upper surface to the tile supporting surface, although batten strips may be used as an alignment means or to prevent the tiles from sliding down a steep roof prior to being fastened thereto. The proposed continuously supported roofing tiles would be installed by nailing directly to the plywood sheathing of the roof.

The rows of subsequent courses would be concealed by the 3 inch overlap of tile toe over the previous row of tile butt. A trim piece (eave closure strip) will be required to mate with the first tile course to conceal the support ribs associated with the first course of tile.

The tiles shown in, for example, FIG. 10, are installed with batten strips as known in the art.

Composition of Tile

The tiles may be composed of light weight concrete, or conventional concrete, as desired.

One composition is such as that disclosed in recently-issued U.S. Pat. No. 5,603,758, entitled "Composition useful for lightweight roof tiles and method of producing said composition", assigned at issue to BORAL CONCRETE PRODUCTS INC, the inventors being Walter A. Schreifels, Jr, Alfonso V Alvarez; Luciano Lopez, and Joseph Smith. This patent issued on Feb. 18, 1997, on an application Ser. No. 540,293 filed Oct. 6, 1996. The application discloses the following composition, among others:

A composition useful for fabricating lightweight roof tiles consisting essentially of, in weight percent:

between about 2.0 to 4.1 latex on solids basis, between about 20.0 to 28.0 cement, between about 28.0 to 55.0 lightweight aggregate, between about 9.0 to 15.0 water;

between about 5.0 to 35.0 standard weight aggregate, and between about 0.0 to 8.0 filler.

With such a composition, it is believed that tiles weighing under six pounds per installed square foot may be provided.

In the case of the "direct-deck" configuration discussed above, it is believed that a tile can be made which covers 157.5 square inches, but weighs less than six pounds.

However, it should be understood that other tile compositions could also be used without departing from the spirit and scope of the present invention. For example, other more conventional tile concrete compositions could be used, or a hybrid composition including a mix of the light weight and conventional compositions.

Conclusion

While this invention has been described in specific detail with reference to the disclosed embodiments, it will be understood that many variations and modifications may be effected within the spirit and scope of the invention as described in the appended claims.

What is claimed is:

1. An apparatus for forming roof tiles for use atop a flat inclined roof top supporting surface, each of said roof tiles having a center axis, an overall width, and an overall thickness, said apparatus comprising:

a conveyor having a longitudinal axis for conveying said roof tiles end-to-end; and a cleaving assembly for cleaving a roof tile portion from one end of each of said roof tiles while on said conveyor, said cleaving assembly including a substantially U-shaped cutting member configured to cleave said roof tile portion such that the roof tile portion has a width less than said overall width and a thickness less than said overall thickness of each of said roof tiles.

2. The apparatus as claimed in claim 1, wherein said cleaving assembly includes a selectively rotatable shaft rotatable about a rotation axis substantially transverse to said longitudinal axis of said conveyor.

3. The apparatus as claimed in claim 2, wherein said U-shaped cutting member of said cleaving assembly is secured to said rotatable shaft and includes a cutting edge which remains substantially parallel to said rotation axis during the rotation of said cutting member along with said shaft.

4. The apparatus as claimed in claim 3, wherein said cleaving assembly further comprises a clutch configured to allow said rotatable shaft to be selectively rotated for one rotational cycle upon engagement of said clutch.

5. The apparatus as claimed in claim 4, wherein said clutch is controlled by a PLC.

6. The apparatus as claimed in claim 1, further comprising a sensor for sensing the presence of a particular roof tile on said conveyor, and further comprising a control device for causing said cleaving assembly to cleave said particular roof tile.

7. The apparatus as claimed in claim 6, wherein said cleaving assembly includes a selectively rotatable shaft rotatable about a rotation axis substantially transverse to said longitudinal axis of said conveyor.

8. The apparatus as claimed in claim 7, wherein said U-shaped cutting member of said cleaving assembly is secured to said rotatable shaft and includes a cutting edge which remains substantially parallel to said rotation axis during the rotation of said cutting member along with said shaft.

9. The apparatus as claimed in claim 8, wherein said cleaving assembly further comprises a clutch configured to allow said rotatable shaft to be selectively rotated for one rotational cycle upon engagement of said clutch.

10. The apparatus as claimed in claim 9, wherein said clutch is controlled by said PLC.

11. An apparatus for forming roof tiles for use atop a flat inclined roof top supporting surface, each of said roof tiles having a center axis, a right side, a left side, an overall width, and an overall thickness, said apparatus comprising:

a conveyor having a longitudinal axis for conveying said roof tiles end-to-end; and a pair of cleaving assemblies, including a first cleaving assembly having a substantially U-shaped cutting member for cleaving a first portion from a first roof tile and a second cleaving assembly having a substantially U-shaped cutting member for cleaving a second portion from a second roof tile, said first and second cleaving assemblies configured such that said first portion is cleaved from said left side of said first roof tile and said first portion has a width less than said overall width and a thickness less than said overall thickness and said second portion is cleaved from said right side of said second roof tile and said second portion has a width less than said overall width and a thickness less than said overall thickness.

12. The apparatus as claimed in claim 11, further comprising a pair of sensors, one for each of said cleaving assemblies, for sensing the presence of particular roof tiles on said conveyor, and further comprising a control device for causing said cleaving assemblies to alternately cleave said first and second portions.

13. The apparatus as claimed in claim 12, wherein each of said cleaving assemblies includes a selectively rotatable shaft rotatable about a rotation axis substantially transverse to said longitudinal axis of said conveyor.

14. The apparatus as claimed in claim 13, wherein said substantially U-shaped cutting member of each of said cleaving assemblies is secured to said rotatable shaft and includes a cutting edge which remains substantially parallel to said rotation axis during the rotation of said cutting member along with said shaft.

15. The apparatus as claimed in claim 14, wherein each of said cleaving assemblies further comprise a clutch configured to allow said rotatable shaft to be selectively rotated for one rotational cycle upon engagement of said clutch.

16. The apparatus as claimed in claim 15, wherein said clutch is controlled by a PLC.

17. An apparatus for forming roof tiles for use atop a flat inclined roof top supporting surface, each of said roof tiles having a center axis, an overall width, and an overall thickness, said apparatus comprising:

a conveyor having a longitudinal axis for conveying said roof tiles end-to-end: and a tile portion removing assembly for removing a roof tile portion from the downstream end of each of said roof tiles while on said conveyor, said portion removing assembly configured to remove a roof tile portion from said remaining roof tile which has a width less than said overall width and a thickness less than said overall thickness of each of said roof tiles.

18. The apparatus as claimed in claim 17, wherein said cleaving assembly includes a selectively rotatable shaft rotatable about a rotation axis substantially transverse to said longitudinal axis of said conveyor.

19. The apparatus as claimed in claim 18, wherein said cutting member of said cleaving assembly is secured to said rotatable shaft and includes a cutting edge which remains substantially parallel to said rotation axis during the rotation of said cutting member along with said shaft.

20. The apparatus as claimed in claim 19, wherein said cleaving assembly further comprises a clutch configured to allow said rotatable shaft to be selectively rotated for one rotational cycle upon engagement of said clutch.

* * * * *